US007625331B2

(12) United States Patent
Philips

(10) Patent No.: US 7,625,331 B2
(45) Date of Patent: Dec. 1, 2009

(54) METHOD AND APPARATUS FOR PROCESSING WOOD VENEERED SUBSTRATE STOCK AND THE LIKE INTO A CONTAINER OR DISPLAY BLANK

(75) Inventor: Nicholas A. Philips, Sugar Grove, IL (US)

(73) Assignee: International Paper Company, Memphis, TN (US)

( * ) Notice: Subject to any disclaimer, the term of this patent is extended or adjusted under 35 U.S.C. 154(b) by 117 days.

(21) Appl. No.: 11/617,914

(22) Filed: Dec. 29, 2006

(65) Prior Publication Data

US 2008/0156165 A1 Jul. 3, 2008

(51) Int. Cl.
*B31B 1/16* (2006.01)

(52) U.S. Cl. ..... 493/363; 493/364; 493/366; 493/372

(58) Field of Classification Search ..... 493/340, 493/363–364, 366, 372
See application file for complete search history.

(56) References Cited

U.S. PATENT DOCUMENTS 3,608,824 A 9/1971 Remington
4,596,541 A 6/1986 Ward, Sr. et al.
5,466,211 A * 11/1995 Komarek et al. ..... 493/355

* cited by examiner

*Primary Examiner*—Christopher Harmon
(74) *Attorney, Agent, or Firm*—Matthew M. Eslami

(57) ABSTRACT

An apparatus for processing sheets of wood veneered substrate stock into product blanks suitable for use in shipping goods, displaying goods, etc: is provided. The apparatus may include either a flat bed or platen die cutting machine or a rotary die cutting machine. In either case, the apparatus further includes a set of die cutting rules suitably configured for processing wood veneered substrate stock. The set of the die cutting rules includes at least one cutting rule and at least one slit scoring rule. The cutting rule includes a cutting blade having a cutting edge. Similarly, the slit scoring rule includes a cutting blade having a cutting edge. The cutting rule and the slit scoring rules are correspondingly dimensioned such that when mounted to the die board, the cutting edge of the cutting rule extends beyond the cutting edge of the slit scoring rule a distance D.

5 Claims, 5 Drawing Sheets

METHOD AND APPARATUS FOR PROCESSING WOOD VENEERED SUBSTRATE STOCK AND THE LIKE INTO A CONTAINER OR DISPLAY BLANK

BACKGROUND

Containers and display components for transporting and displaying goods have been utilized for many years. Such containers or display components are typically constructed from a suitable blank made from an appropriate substrate sheet, such as corrugated fiberboard. As generally known in the an, the blank is processed from a sheet of appropriate substrate stock to include panels, flaps, etc., hingedly corrected to one another via score lines. The blank is then folded along these score lines and glued to form the final product for the shipment of goods, point of sale displays, advertising displays, and the like.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present invention, an apparatus for processing wood veneered substrate stock into product blanks is provided. The wood veneered substrate stock comprises a wood veneer layer affixed to one or more paper layers. The apparatus comprises a non-resilient support surface for supporting the substrate stock during processing thereof, a rule holder positioned adjacent to and spaced from the support surface such that the substrate stock is disposed between the rule holder and the support surface during processing thereof, and at least one slit scoring rule mounted on the rule holder. The slit scoring rule has a cutting edge for penetrating one or more layers of the substrate stock. The apparatus further includes at least one cutting rule mounted on the rule holder for cutting through the entire thickness of the wood veneered substrate stock. The cutting rule has a cutting edge that extends beyond the slit scoring rule cutting edge a fixed distance D substantially equal to the aggregate thickness of the paper layers for controlling the depth of cut into the substrate stock by the slit scoring rule.

In accordance with another aspect of the present invention, an apparatus for processing wood veneered substrate stock into product blanks is provided. The wood veneered substrate stock comprises a wood veneer layer and one or more non-corrugated paper layers. The apparatus comprises a non-resilient support surface for supporting the wood veneered substrate stock during processing thereof a rule holder positioned adjacent to and spaced from the support surface such that the substrate stock is disposed between the rule holder and the support surface during processing thereof, at least one slit scoring rule mounted on the rule holder, wherein the slit scoring rule has a cutting edge for penetrating one or more layers of the substrate stock, and at least one cutting rule mounted on the rule holder for cutting through the entire thickness of the substrate stock, wherein the cutting rule has a cutting edge that extends beyond the slit scoring rule cutting edge a fixed distance D substantially equal to the total aggregate thickness of the substrate layers minus the sum of the thickness of the wood veneer layer and up to approximately 50% of the thicknesses of the paper layers for controlling the depth of cut into the substrate stock by the slit scoring rule.

In accordance with another aspect of the present invention, a method for processing a wood veneered substrate into a blank is provided, wherein the wood veneered substrate stock includes a wood veneer outer layer and one or more paper base layers. The method comprises advancing the wood veneered substrate stock into a processing apparatus. The processing apparatus comprises a non-resilient support surface for supporting the substrate stock during processing thereof, a rule holder positioned adjacent to and spaced from the support surface such that the substrate stock is disposed between the rule holder and the support surface during processing of the substrate stock, at least one slit scoring rule mounted on the rule holder, wherein the slit scoring rule has a cutting edge for penetrating one or more layers of the substrate stock, and at least one cutting rule mounted on the rule holder for cutting through the entire thickness of the wood veneered substrate stock, wherein the cutting rule has a cutting edge extending beyond the slit scoring rule cutting edge a fixed distance D for controlling the depth of cut into the sheet stock by the slit scoring rule. The distance D is substantially equal to the aggregate thickness of the paper layers or substantially equal to the total aggregate thickness of the substrate layers minus the sum of the thickness of the wood veneer layer and up to approximately 50% of the thicknesses of the paper layers. The method further includes moving the cutting rule and the slit scoring rule into contact with the substrate stock and removing the cutting rule and the slit scoring rule from contact with the substrate stock.

DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION

Exemplary embodiments of the present invention will now be described with reference to the accompanying drawings where like numerals correspond to like elements. Exemplary embodiments of the present invention are directed to methods for processing substrate stock and apparatuses on which the substrate stock are processed. More specifically, embodiments of the present invention are directed to methods for processing wood veneered substrate stock into wood veneered blanks and apparatuses on which the wood veneered substrate stock may be processed.

Wood veneered substrate stock may be formed by attaching a wood veneer layer onto any cellulose based substrate. Cellulose based substrates are formed from cellulose materials such as wood pulp, straw, cotton, bagasse and the like. Cellulose based substrates useful in the present invention come in many forms, including but not limited to fiberboard, corrugated or solid fiberboard, containerboard, paperboard, linerboard, boxboard, chipboard, combined board, or combinations thereof.

Figure 3:
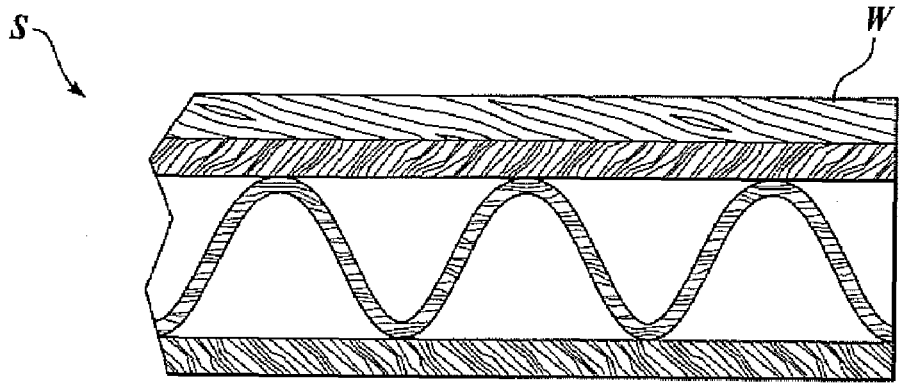
FIG. 3 is a partial side view of one embodiment of wood veneered substrate stock that may be practiced with aspects of the present invention.
Figure 4:
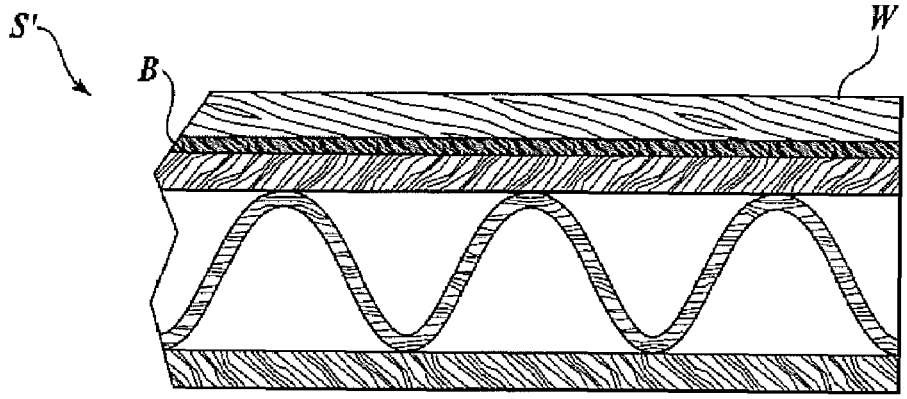
FIG. 4 is partial side view of another embodiment of wood veneered substrate stock that may be practiced with aspects of the present invention.

The wood veneer layer may be of any species of wood, and is adhered or otherwise attached to the outer surface of the desired cellulous based substrate. In several embodiments, the wood veneer layer W may be attached directly to the cellulous based substrate, as best shown in FIG. 3. In other embodiments, the wood veneer layer W is attached first to a paper substrate, sometimes referred to as a paper backing B, which is then attached to the cellulous based substrate, as best shown in FIG. 4. It will be appreciated that the wood veneer layer W and its optional paper backing B are not limited to any specific thickness; however, several embodiments of the wood veneered substrate stock practiced with aspects of the present invention include wood veneer layers and paper backing layers having thicknesses in the range of between approximately 0.002 and 0.02 inches.

Sheets of wood veneered substrate stock may be formed using any method known in the art. For example, the wood veneer layer may be presented in roll form to a corrugating machine, known as a corrugator, to be combined with, for example, a corrugated single-face substrate. In other examples, the wood veneer layer may be presented in stacked cut-sheet form to a single-face laminator to be combined with, for example, a corrugated single-face substrate. In further examples, the wood veneer layer may be presented in stacked cut-sheet form to a labeling machine to be combined with, for example, a corrugated single-wall substrate.

The following discussion proceeds with reference to examples of wood veneered substrates in the form of wood veneered corrugated and non-corrugated fiberboard stock, but it should be understood that the scope of the present invention is not so limited. It will be further appreciated that the fiberboard stock utilized to form exemplary wood veneered corrugated fiberboard stock may include but is not limited to single-face corrugated fiberboard, single-wall corrugated fiberboard, double-wall corrugated fiberboard, triple-wall corrugated fiberboard, etc. It should therefore be apparent that the examples described below are only illustrative in nature, and therefore, such examples should not be considered as limiting the scope of the present invention, as claimed.

Figure 1:
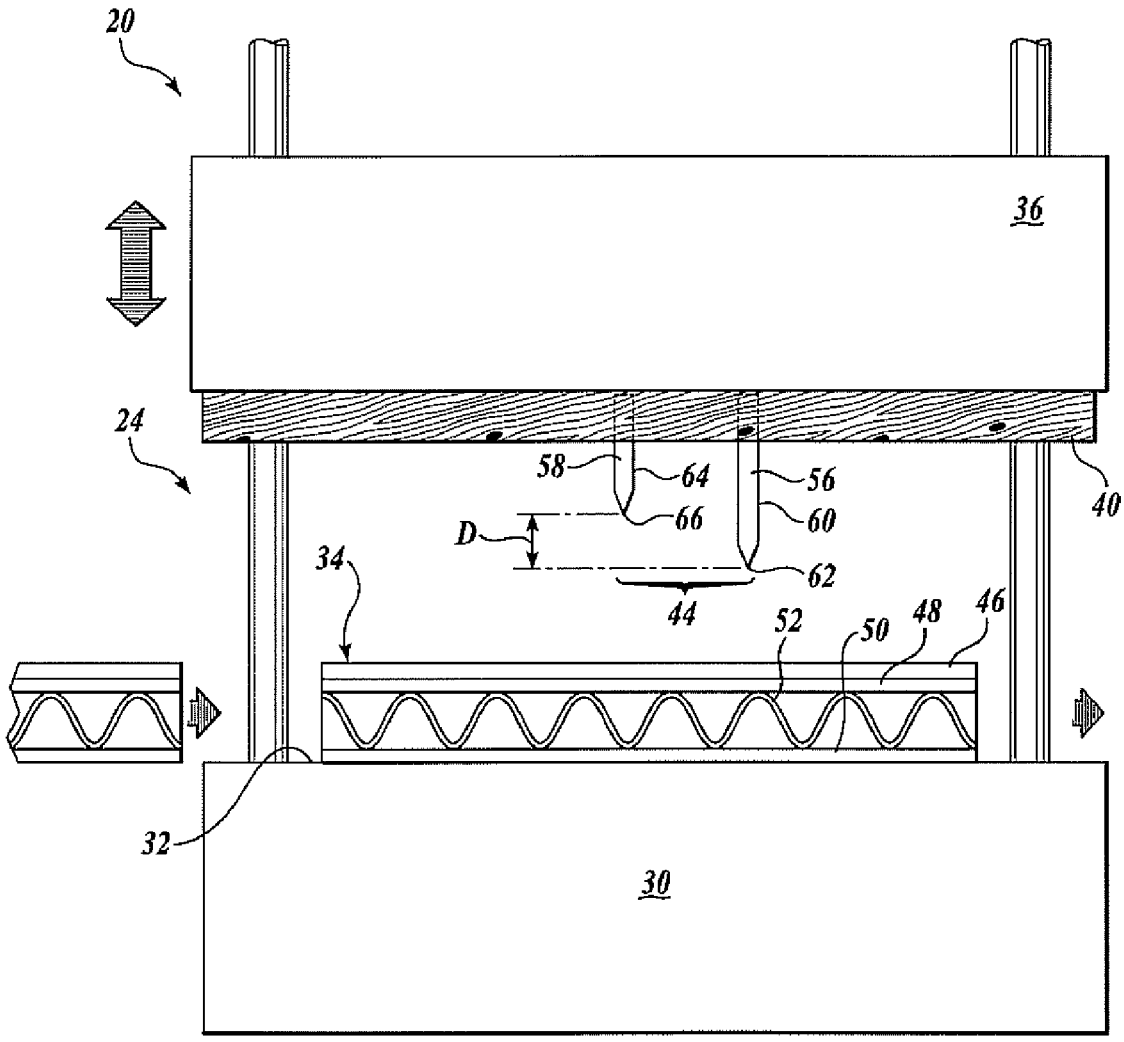
FIG. 1 is a schematic illustration in side elevation of one embodiment of an apparatus for processing wood veneered substrate stock formed in accordance with aspects of the present invention.

Turning now to FIG. 1, there is shown a schematic representation of one exemplary embodiment of a container or display blank processing apparatus, generally designated 20, formed in accordance with aspects of the present invention. As will be described in more detail below, the apparatus 20 is configured for processing sheets of wood veneered substrate stock into product blanks suitable for use in shipping goods, displaying goods, etc. As best shown in FIG. 1, the apparatus 20 includes a flat bed or platen die cutting machine 24. The flat bed die cutting machine 24 includes a stationary metallic platen 30 having a planar, rigid (non-resilient) support surface 32 for supporting a wood veneered substrate stock 34, a movable platen 36 juxtaposed a spaced distance from the platen 30 to which a conventional planar die board 40 is mounted. The apparatus 20 further includes a set 44 of die cutting rules suitably configured for processing wood veneered substrate stock, as will be described in detail below. The set 44 of die cutting rules is mounted to the die board 40 and is movable by the platen 36 between a substrate non-contact position shown in FIG. 1 and a substrate processing position shown in FIG. 2. The platen 36 is movable between the substrate non-contact position and the substrate processing position via conventional actuators (not shown) well known in the art.

The term die cutting rules is used herein in the generic sense to cover all processing die rules, such as cutting rules, slit scoring rules, scoring rules, etc. The set 44 of rules are arranged in a pattern that determines one or more of the following: (1) the final shape of the container or display component blank; (2) the location and size of any desired cut-outs; and (3) location and size of any score lines, either formed by slit scoring rules or scoring rules (non-penetrating rules) along which the blank may be folded to form a box, container, display stand, or the like. As used herein, the term "cutting rule" means any rule that penetrates or cuts through the entire wood veneer and substrate stock, the term "slit scoring rule" means any rule that creates fold lines by penetrating one or more layers of wood veneer and/or the substrate stock without fully penetrating the entire substrate stock thickness, and the term "scoring rule," also known as creasing rule, means any rule that creates fold lines without penetrating any layer of the substrate sheet but instead crushes, creases, indents, or otherwise weakens the wood veneer and/or substrate locally.

In accordance with aspects of the present invention, the set 44 of die cutting rules will now be described in more detail with reference to FIGS. 1 and 2. As will be described in more detail below, the set 44 of rules is specifically configured to work in conjunction with the rigid support surface 32 so as to provide precise control over the depth of penetration of the slit scoring rules. This results in less non-usable blanks, or stated conversely, this increases the acceptable yield of the processed blanks. Such benefits are desirable when using wood veneered substrate stock due to the higher costs associated therewith.

Figure 2:
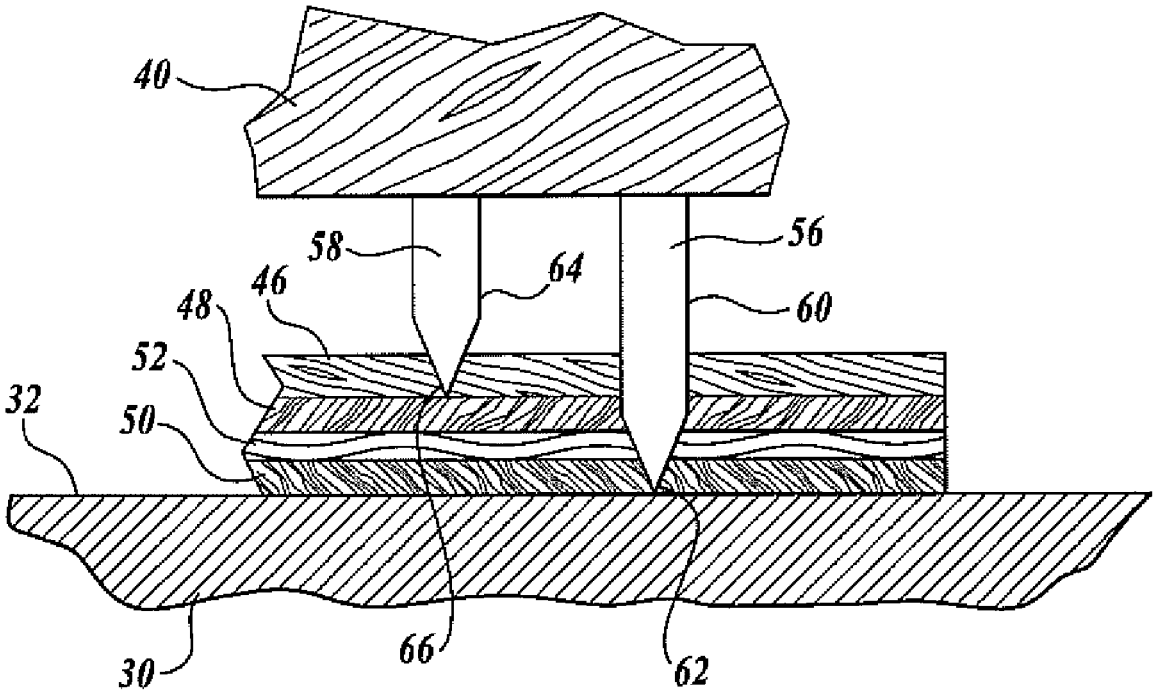
FIG. 2 is an enlarged partial view shown in cross section of corrugated fiberboard stock being processed by the apparatus of FIG. 1.
Figure 6:
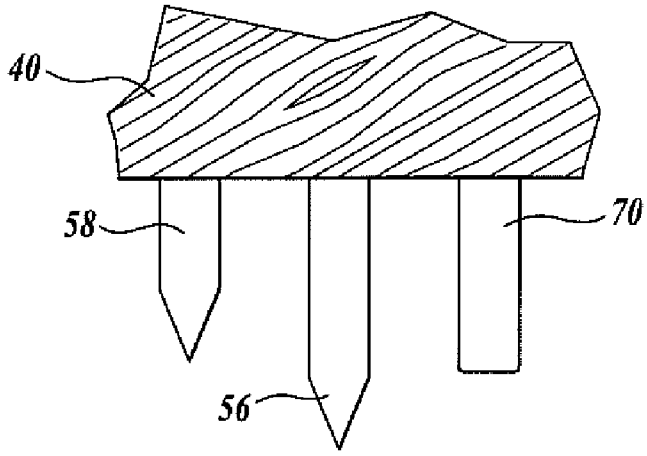
FIG. 6 is a partial side view of one embodiment depicting a scoring rule extending from a die holder of the apparatus of FIG. 1.
Figure 7:
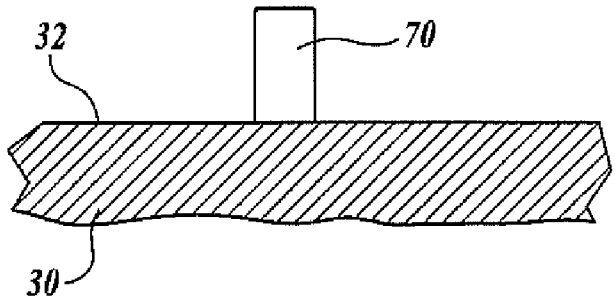
FIG. 7 is a partial side view of one embodiment depicting a scoring rule extending from a platen of the apparatus of FIG. 1.

FIG. 2 illustrates a partial side elevation of the wood veneered substrate stock 34 being processed by the apparatus 20. In the embodiment shown in FIG. 2, the wood veneered substrate stock 34 includes a wood veneer layer 46, a top liner 48, a bottom liner 50, and a corrugated medium layer 52 disposed between the top and bottom liners in a fluted configuration. In FIG. 2, the substrate stock 34 is shown in its crushed condition where the corrugated medium 52 is pressed substantially flat by sufficient compression forces applied to the top and bottom liners. Turning now to the description of the set 44 of the die cutting rules, the set 44 includes at least one cutting rule 56 and at least one slit scoring rule 58, as best shown in FIGS. 1 and 2. It will be appreciated that the apparatus 20 may include other rules, such as scoring rules, which may or may not be part of the set 44. For example, at least one scoring rule 70 may be mounted to the die board 40 as best shown in FIG. 6, mounted to the support surface 32 as best shown in FIG. 7, or mounted to a counterplate (not shown) supported by the support surface 32, depending on the desired pattern for the processed blank. The cutting rule 56 includes a cutting blade 60 having a cutting edge 62. Similarly, the slit scoring rule 58 includes a cutting blade 64 having a cutting edge 66. Both the cutting rule 56 and the slit scoring rule 58 may be formed with either single or double bevel straight edged cutting blades.

The set 44 of die cutting rules is mounted in a conventional manner to the planar die board 40. The cutting rule 56 and the slit scoring rules 58 are correspondingly dimensioned such that when mounted to the die board 40, the cutting edge 62 of the cutting rule 56 extends beyond the cutting edge 66 of the slit scoring rule 58 a distance D. This distance D is also referred to herein as the height differential between the cutting edges of the cutting rule 56 and the slit scoring rule 58.

In accordance with aspects of the present invention, such distance D provides for precision control of the depth of penetration of the slit scoring rule 58 into the wood veneer substrate stock during processing. In embodiments of the present invention, the distance D is somewhat substrate dependent as will now be described in more detail. For example, in embodiments where the wood veneered substrate stock includes at least one corrugated medium layer, such as single-face or single-wall substrate stock (with or without a paper backing B), examples of which are shown in FIGS. 3 and 47 acceptable results have been achieved where the distance D is equal to the aggregate total of the thicknesses of the paper layers. Stated differently, acceptable results have been achieved where the distance D is equal to the sum of the thicknesses of all layers of the wood veneered substrate stock minus the thickness of the wood veneer layer. It will be appreciated that the thickness measurements for D may be within a tolerance of approximately 0.005 inches.

In embodiments that utilize substrate stock with two or more corrugated medium layers, such as wood veneered double-wall and triple-wall stock, and a paper backing B, it may be possible for the slit-scoring rule 58 to penetrate through the wood veneer layer and up to the entire thickness of the paper backing B. It will be appreciated that in these embodiments and embodiments without paper backings B, scorings rules 70 associated with the platen 30 may be utilized for forming fold lines (non-penetrating score lines) on the side of the substrate opposite the wood veneer. The fold lines would be of an appropriate length and width, and suitably positioned for working in conjunction with the slit scores formed by the slit scoring rules 58 so that the processed blank is capable of folding in the desired location(s). Alternatively, in these embodiments and embodiments without paper backings B, fold lines may be formed by the cutting rules 56 and the slit scoring rules 58 suitably oriented to form perforation scores or by suitably configured perforating rules.

In embodiments of the present invention in which the substrate stock includes at least one corrugated medium layer, in order to precisely control the depth of the slit scores lines it is preferably that the distance D is measured when the wood veneered substrate stock is in its crushed condition, as shown in FIG. 2. As stated earlier, the crush condition is when enough force is applied to the top and bottom of the sheet so that the corrugated medium layer is pressed substantially flat.

Figure 5:
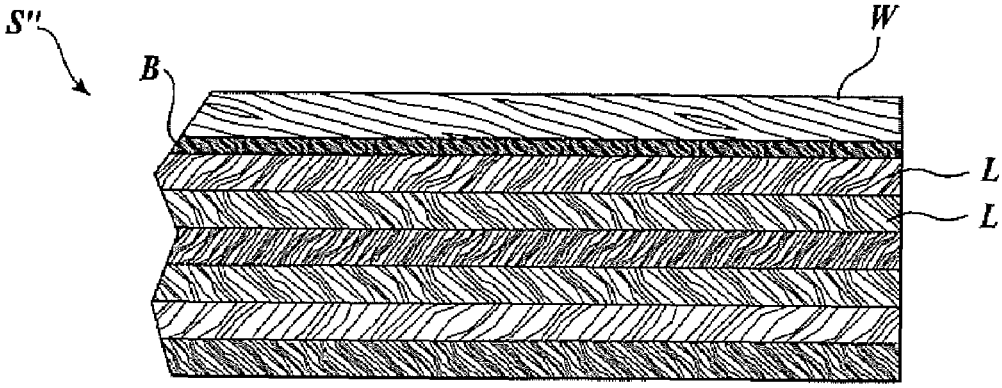
FIG. 5 is partial side view of another embodiment of wood veneered substrate stock that may be practiced with aspects of the present invention.

In other embodiments where the substrate stock does not include a corrugated medium layer, but includes two or more solid layers of substrate, such as linerboard, acceptable results have been achieved where the distance 9 is equal to the total aggregate thickness of the substrate layers minus the sum of the thickness of the wood veneer layer and up to approximately 50% of the thicknesses of the paper layers. One exemplary embodiment of a wood veneered substrate S" that is comprised of a plurality of solid layers L without a corrugated medium layer is shown in FIG. 5. It will be appreciated that the thickness measurements for D may be within a tolerance of approximately 0.005 inches.

Figure 8:
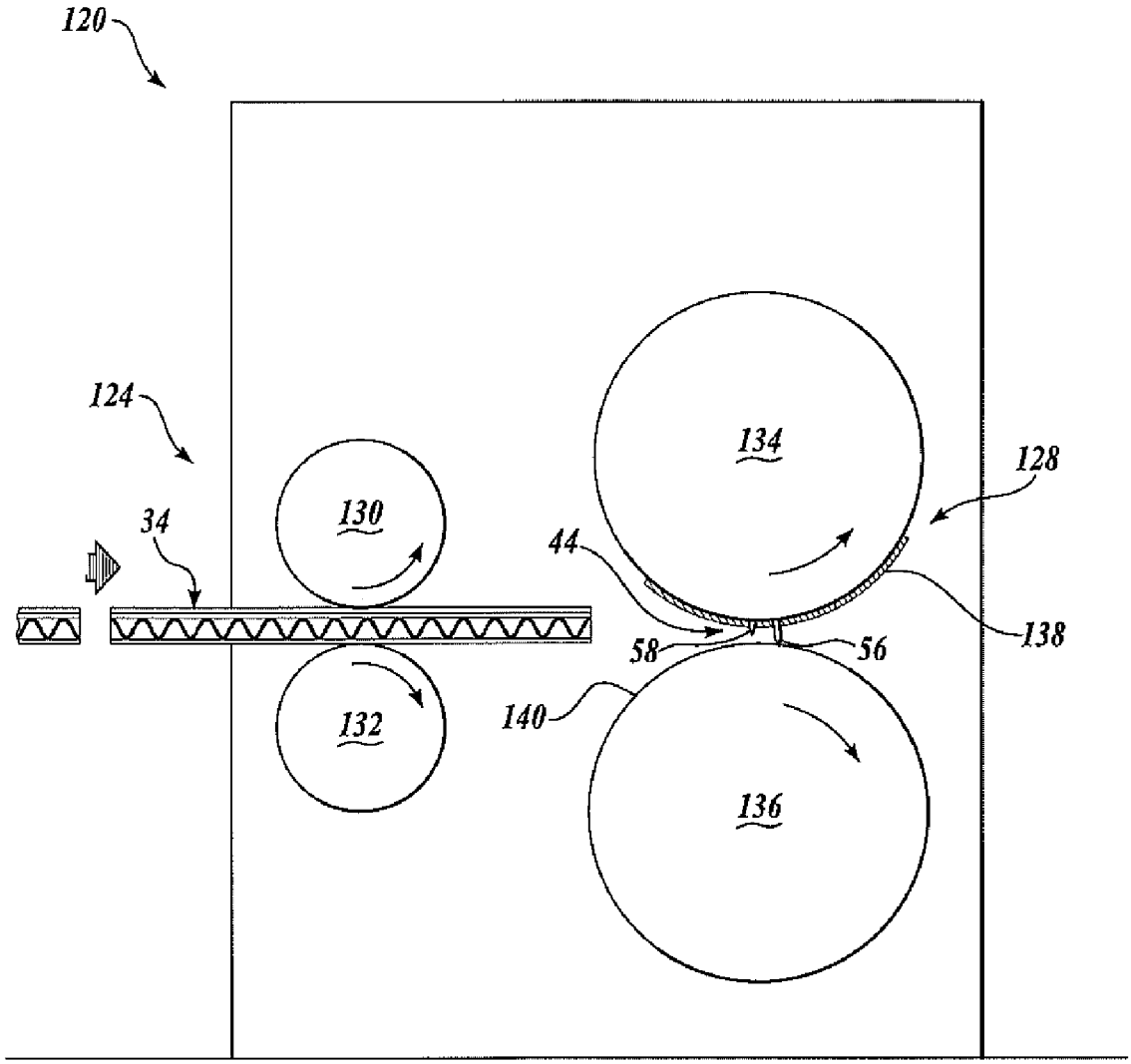
FIG. 8 is a schematic illustration in side elevation of another embodiment of an apparatus for processing wood veneered substrate stock formed in accordance with aspects of the present invention.

Referring now to FIG. 8, there is shown another embodiment of an apparatus 120 for processing wood veneered substrate stock formed in accordance with aspects of the present invention. As best shown in FIG. 8, the apparatus 120 includes a rotary die cutter machine 124. The rotary die cutter machine 124 includes a rotary die cutter section 128 that is fed sheets of wood veneered substrate stock, such as substrate stock 34, either manually or via conventional infeeder/conveyance means. In the embodiment shown, the sheets 34 are advanced serially toward and into the cutter section 128 by a pair of feed rolls 130 and 132.

The die cutting section 128 includes an upper rotary cutting cylinder 134 and a lower impression cylinder 136 supported for rotation in a conventional manner. The upper rotary cutting cylinder 134 is conventionally constructed from a metal tube. The tube portion has a plurality of tapped holes therein (not shown) so that an arcuate plywood die board 138 may be bolted thereto. A set 44 of rules comprising at least one cutting rule 56 and at least one slit scoring rule 58 is secured to the die board 138 in a conventional manner. The lower impression cylinder 136 is conventionally constructed from a metal tube having a rigid (non-resilient) support surface 140. One metal to metal rotary die cutter machine that may be practiced with the present invention is the Maramatsu model #MN02500-2F.

Processing a wood veneered substrate stock with the apparatus 20 will now be described with reference to FIGS. 1 and 2. A conventional flat die board 40 for the flat platen 30 is prepared with a least one cutting rule 56 mounted thereto in a conventional manner for cutting at least a portion of the final shape of the container blank. Similarly, at least one slit scoring rule 58 is mounted in the die board 40 of such size and such location so as to provide a slit in the substrate along which a portion of the finished blank is to be precisely folded. Other rules, such as scoring rules 70, may be mounted to the die board 40, mounted to the support surface 32, or alternatively mounted to a counterplate, which is, in turn, placed in supporting relation with the support surface 32.

To precisely control the depth of penetration of the slit scoring rule 58, the rules 56 and 58 are specifically sized and mounted such that the cutting edge 62 of the cutting rule 56 extends a predetermined distance D away from the cutting edge 66 of the slit scoring rule 58. The distance D is predetermined by either measuring the layers of the wood veneered substrate stock prior to processing or obtaining the measurements of each layer of the wood veneered substrate stock from previous production runs utilizing the same substrate stock so that the depth of penetration of the slit scoring rule 58 is precisely controlled, resulting in an increased yield of usable processed blanks. As was described above, the predetermined distance is somewhat dependent on several factors, such as the thicknesses of the substrate layers and the use of corrugated medium layer(s) in the substrate. In embodiments where the wood veneered substrate stock includes a corrugated medium layer, including substrate 34 shown in FIGS. 1 and 2, and substrates S and S' shown in FIGS. 3 and 4, the distance D, or the height differential between the cutting edge 62 of the cutting rule 56 and the cutting edge 66 of the slit scoring rule 58, is such that the cutting edge 62 of the cutting rule 56 will penetrate the entire substrate stock and contact the support surface 32 while the cutting edge 66 of the slit scoring rule 58 will penetrate the thickness of the wood veneer layer while leaving the remaining paper layers uncut.

The fully prepared die board 40 is then secured to the movable platen 36 in a conventional manner. As the machine is operated, sheets of substrate stock, for example, substrate stock 34, are sequentially advanced between the platens 30, 36 either manually or automatically. The platen 36 is then moved into and out of engagement with the platen 30 for processing the substrate stock. In these embodiments, the substrate stock is processed with the wood veneered layer facing the set 44 of rules. As such, the cutting rule 56 will cut a portion of the shape of the final blank and the slit scoring rule 58 will simultaneously slit at least the wood veneer layer of the substrate stock for forming slit scores.

Since the apparatus 20 utilizes a rigid metallic support surface 32 that is non-resilient in conjunction with a predetermined height differential between the cutting edge 62 of the cutting rule 56 and the cutting edge 66 of the slit scoring rule 58, the depth of penetration of the slit scoring rule 58 can be precisely controlled. More specifically, as best shown in FIG. 2, when the cutting edge 62 of the cutting rule 56 cuts through the entire substrate stock 34 and contacts the support surface 32, the cutting rule 56 acts as a stopping mechanism in that the slit scoring rule 58 is prevented from further penetrating movement through the substrate stock 34 because of the rigid support surface 32. Accordingly, this limits the penetration depth of the cutting edge 66 of the slit scoring rule 58 to precisely the interface between the wood veneered layer 46 and the first liner 48 (could also be the paper backing, if used) in embodiments with corrugated medium layers, and a penetration depth of no more than the wood veneered layer and up to 50% of the paper layers of embodiments without a corrugated medium layer, such as substrate S" shown in FIG. 5.

If the wood veneered substrate stock 34 is to be processed on the apparatus 120 utilizing a metal to metal rotary die cutting machine, an arcuate die board 138 is prepared in the same manner as the flat die board 40. The arcuate die board 138 is then mounted in the usual manner to the rotary cutting cylinder 134. As the machine is operated, sheets of wood veneered substrate stock, such as substrate stock 34, are sequentially advanced through cylinders 134 and 136 with the wood veneered layer facing the cutting cylinder 134. The cutting rule(s) 56 will cut a portion of the shape of the final blank and the slit scoring rule(s) 58 will simultaneously slit the wood veneer layer of the substrate stock for forming slit scores.

Although the detailed description has been described herein with reference to exemplary embodiments illustrated in the attached drawings, it is noted that substitutions may be made and equivalents employed herein without departing from the scope of the present invention as recited in the claims.

The embodiments of the invention in which an exclusive property or privilege is claimed are defined as follows:

1. A method for processing a wood veneered substrate into a blank, the method, comprising:

providing a wood veneered substrate stock comprising a wood veneer outer layer and one or more paper base layers, some of which may be of fluted paper;

simultaneously pre-crushing the wood veneer outer layer and one or more paper base layers;

measuring a thickness of the wood veneer outer layer and one or more paper base layers in a compressed condition and then using a processing apparatus having (a) a non-resilient support surface for supporting the substrate stock during processing thereof, (b) a rule holder positioned adjacent to and spaced from the support surface such that the substrate stock is disposed between the rule holder and the support surface with the wood veneer outer layer being first contacted and penetrated by the rules in the rule holder first during processing of the substrate stock, (c) at least one slit scoring rule mounted on the rule holder, the slit scoring rule having a cutting edge for penetrating one or more layers of the substrate stock, and (d) at least one cutting rule mounted on the rule holder for cutting through the entire thickness of the wood veneered substrate stock; and calculating a fixed distance D that is substantially equal to the aggregate thickness of the paper layers or substantially equal to the total aggregate thickness of the substrate layers minus the sum of the thickness of the wood veneer layer and up to approximately 50% of the thicknesses of die paper layers.

2. The method of claim 1, wherein the measurement is taken for each layer when the substrate is ins crushed condition.

3. The method of claim 1, wherein the one or more paper base layers are fluted paper.

4. The method of claim 1, wherein the one or more layers includes at least one paper backing disposed directly adjacent the wood veneer layer.

5. The method of claim 1, thither including a flat rule holder upon which the sift scoring rule and the cutting rule arc mounted, the support surface being miter surface of a flat rigid platen against which the wig holder is movable for supporting the substrate stock.

* * * * *

UNITED STATES PATENT AND TRADEMARK OFFICE

CERTIFICATE OF CORRECTION

PATENT NO. : 7,625,331 B2
APPLICATION NO. : 11/617914
DATED : December 1, 2009
INVENTOR(S) : Nicholas A. Philips It is certified that error appears in the above-identified patent and that said Letters Patent is hereby corrected as shown below:

Column 1 lines 8-18, should be corrected as follows:

Containers and display components for transporting and displaying goods have been utilized for many years. Such containers or display components are typically constructed from a suitable blank made from an appropriate substrate sheet, such as corrugated fiberboard. As generally known in the art, the blank is processed from a sheet of appropriate substrate stock to include panels, flaps, etc., hingedly connected to one another via score lines. The blank is then folded along these score lines and glued to form the final product for the shipment of goods, point of sale displays, advertising displays, and the like.

Column 1, line 53, should be corrected as follows:

strate stock during processing thereof, a rule holder positioned.....

Column 5, line 22, should be corrected as follows:

and 4, acceptable results have been achieved where the dis-.....

Column 5, line 59, should be corrected as follows:

results have been achieved where the distance D is equal to the.....

Column 8, Claim 1, line 31-32, should be corrected as follows:

veneer layer and up to approximately 50% of the thicknesses
of the paper layers.

Column 8, Claim 2, lines 33-35, should be corrected as follows:

Claim 2. The method of claim 1, wherein the measurement is taken for each layer when the substrate is in a crushed condition.

Signed and Sealed this

Eighth Day of June, 2010

David J. Kappos

David J. Kappos
*Director of the United States Patent and Trademark Office*

Column 8, Claim 5, lines 41-45, should be corrected as follows:

Claim 5. The method of claim 1, further including a flat rule holder upon which the sift scoring rule and the cutting rule are mounted, the support surface being an outer surface of a flat rigid platen against which the rule holder is movable for supporting the substrate stock.